United States Patent [19]

Prewo et al.

[11] Patent Number: 4,885,212

[45] Date of Patent: Dec. 5, 1989

[54] MICROSTRUCTURALLY TOUGHENED METAL MATRIX COMPOSITE ARTICLE AND METHOD OF MAKING SAME

[75] Inventors: Karl M. Prewo, Vernon; Vincent C. Nardone, Meriden; James R. Strife, South Windsor, all of Conn.

[73] Assignee: United Technologies Corporation, Hartford, Conn.

[21] Appl. No.: 152,781

[22] Filed: Feb. 5, 1988

[51] Int. Cl.[4] ..... B22F 3/00

[52] U.S. Cl. ..... 428/552; 419/8; 419/48

[58] Field of Search ..... 428/546, 552; 419/8, 419/48

[56] References Cited

U.S. PATENT DOCUMENTS

| | | | |
|---|---|---|---|
| 3,803,702 | 4/1974 | Bratt | 419/8 |
| 4,025,313 | 5/1977 | Slatts | 419/8 |
| 4,721,598 | 1/1988 | Lee | 419/8 |
| 4,756,677 | 7/1988 | Hribernik et al. | 419/8 |
| 4,793,967 | 12/1988 | Pryor et al. | 419/48 X |
| 4,808,485 | 2/1989 | Prewo et al. | 419/48 X |

OTHER PUBLICATIONS

D. W. Kum, T. Oyama, J. Wadsworth and O. D. Sherby, *The Impact Properties of Laminated Composites Containing Ultrahigh Carbon (UHC) Steels,* J. Mech. Phys., vol. 31, No. 2, pp. 173–186, 1983.

*Primary Examiner*—Peter A. Nelson
*Attorney, Agent, or Firm*—Kevin E. McVeigh

[57] ABSTRACT

A microstructurally toughened ceramic-particle-reinforced metal-matrix composite article is disclosed. The article exhibits a complex microstructure. The article exhibits high tensile strength, high elastic modulus and high impact resistance. A process for making the article is also disclosed. The process includes positioning structural elements within a metallic container to define one or more void spaces within the container, introducing a quantity of metallic particles or of a particular mixture of metallic particles and ceramic particles into the void spaces, and consolidating the container, structural elements and particles to form the microstructurally toughened composite article.

6 Claims, 1 Drawing Sheet

MICROSTRUCTURALLY TOUGHENED METAL MATRIX COMPOSITE ARTICLE AND METHOD OF MAKING SAME

DESCRIPTION

1. Technical Field

This invention pertains to metal matrix composite materials and articles made therefrom.

2. Background Art

Metal matrix composites have been developed which offer high specific strength and high specific stiffness. An emerging class of metal matrix composites contain discontinuous ceramic reinforcement. The discontinuous nature of the reinforcement allows this class of metal matrix composites to be formed into complex shapes using conventional metal working processes. While discontinuous ceramic reinforced metal matrix composites exhibit increased strength and stiffness relative to the base metal, the composite materials typically exhibit substantially reduced impact resistance relative to the base metal. The lack of impact resistance translates directly into a structural reliability problem and poses a significant obstacle to the wide spread use of discontinuous ceramic reinforced metal matrix composites in load bearing applications.

What is needed in the art is material which overcomes the above problem.

DISCLOSURE OF INVENTION

A composite article which exhibits high tensile strength parallel to a first axis of the article, high elastic modulus parallel to the first axis, and high impact resistance perpendicular to the first axis is disclosed. One embodiment of the article comprises a reinforced region and a plurality of discrete metallic regions. Each of the regions substantially continuously extends along the first axis of the article from a first end of the article to a second end of the article. The reinforced region forms a two-dimensional network perpendicular to the first axis to separate each metallic region from each of the other metallic regions and at least two of the discrete metallic regions are each substantially enclosed in all directions perpendicular to the first axis by the reinforced region. The reinforced region comprises a metal matrix reinforced with ceramic particles and the metallic region comprises a metal alloy.

Another embodiment of the composite article of the present invention includes a first reinforced region and a plurality of second reinforced regions each embedded in the first reinforced region. Each of the regions substantially continuously extends along the first axis of the article from a first end of the article to a second end of the article. The first reinforced region forms a two-dimension network perpendicular to the first axis to separate each second reinforced region from each of the other second reinforced regions. Each of the second reinforced regions is defined by a stable interfacial boundary between the first reinforced region and each second reinforced region. The first reinforced region comprises a metal matrix reinforced with ceramic particles, and each second reinforced region comprises a metal matrix reinforced with ceramic particles.

Another embodiment of the composite article of the present invention includes a metal region and a plurality of discrete reinforced regions. Each of the regions substantially continuously extends along a first axis from the first end of the article to the second end of the article. The metallic region forms a two-dimensional network perpendicular to the first axis to separate each reinforced region from each of the other reinforced regions and at least two of the discrete reinforced regions are each substantially enclosed in all directions perpendicular to the first axis. The metallic region comprises a metal alloy, and the reinforced regions each comprise a metal alloy matrix reinforced with ceramic particles.

A process for making a composite article is disclosed. The process comprises providing a metallic container, positioning a plurality of longitudinally extending metallic rods within the metallic container to define one or more longitudinally extending void spaces within the container, introducing a quantity of a particulate mixture of metallic particles and ceramic particles into each of the void spaces and consolidating the metallic container, the metallic rods, and the particulate mixture to form the composite article.

A further aspect of the disclosure involves a process for making a composite article which includes providing a metallic container, positioning a plurality of particulate-ceramic-reinforced-metal matrix rods along the first axis within the container to define one or more longitudinally extending void spaces within the container, introducing a quantity of a particulate mixture of metallic particles and ceramic particles into each of the void spaces, and consolidating the metallic container, the rods and the particulate mixture to form the composite article.

A further aspect of the disclosure includes a process for making a composite article which includes providing a metallic container, positioning a plurality of particulate ceramic reinforced metal matrix rods within the metallic containers to define one or more longitudinally extending void spaces within the container, introducing a quantity of metallic particles into each of the void spaces and consolidating the metallic container, the rods and the metallic particles to form the composite article.

The forgoing and other features and advantages of the present invention will become more apparent from the following description and accompanying drawings.

BEST MODE FOR CARRYING OUT THE INVENTION

A composite article of the present invention exhibits a complex microstructure.

Figure 1:
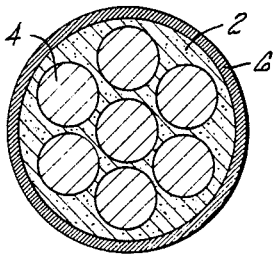
FIG. 1 shows a schematic cross-sectional view of a composite rod of the present invention.
Figure 2:
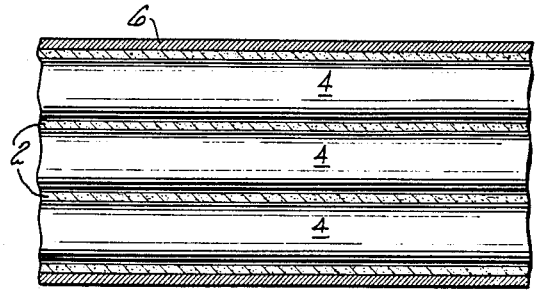
FIG. 2 shows a schematic longitudinal sectional view of the composite rod of FIG. 1.

The microstructure of a composite rod of the present invention is shown in FIGS. 1 and 2.

FIG. 1 shows a cross-sectional view of a composite rod of the present invention. A reinforced region 2 forms a two-dimensional network in the cross-sectional plane to separate each of a plurality of metallic regions 4 from each of the other metallic regions 4. Each of the metallic regions is completely enclosed in all directions in the cross-sectional plane by the reinforced region 2. The reinforced region 2 is enclosed in a metallic sheath 6.

The reinforced region 2 comprises a metal alloy matrix reinforced with ceramic particles. The metallic regions 4 each comprise unreinforced metal alloy. The metal alloy of the reinforced region may be a different metal alloy than the metal alloy of the metallic regions. The composition of the respective regions is discussed in more detail below.

In the preferred embodiment shown in FIG. 1, the metallic regions 4 each have a circular cross-sectional shape. The metallic regions may have cross-sectional shapes other than circular, and each of the metallic regions may have a cross-sectional shape that is different from the other metallic regions. For example, the metallic regions may have an ovoid, square, rectangular or other noncircular cross-sectional shape. The reinforced region may have any shape complementary to the shape of the metallic regions.

Each of the metallic regions and reinforced regions is contiguous with other regions and the contiguous regions are interconnected to form a coherent article. Each of the regions adjoins other regions of the article and is bonded to the regions which it adjoins to form a common interface between the adjoining regions. The common interface may be characterized by interfacial shear strength. The interfacial shear strength of each common interface is sufficiently high so that load may be transferred between the adjoining regions. It is preferred that each common interface be stable within the temperature range of intended use, and it is particularly preferred that each common interface be sharply defined. A stable interface is one which does not change over time. A sharply defined interface is an interface which provides an abrupt, rather than gradual, transition between adjoining regions. A stable, sharply defined interface between adjoining regions may be obtained if the composition of the adjoining regions is chosen so that only limited interdiffusion occurs between the adjoining regions at temperatures up to and including the intended use temperature.

While a composite article of the present invention may include as few as two discrete metallic regions, improved performance may be obtained if the number of metallic regions is increased. It is preferred that the article include five or more metallic regions, and particularly preferred that the article comprise ten or more metallic regions.

While is it sufficient for the purposes of the present invention that two metallic regions are each substantially enclosed by the reinforced regions, improved performance may be obtained by increasing the number of enclosed metallic regions, and it is preferred that five or more metallic regions be enclosed by the reinforced region.

While in the preferred embodiment shown in FIGS. 1 and 2, a single continuous metallic region 6 defines the outer perimeter of the cylindrical rod, it should be noted that a composite bar machined from the composite rod shown in FIGS. 1 and 2 and having a square or rectangular cross-sectional shape with its rectilinear perimeter defined by alternating metallic and reinforced surfaces and having at least two metallic regions which are completely enclosed in the reinforced region is another embodiment of the present invention.

FIG. 2 shows a longitudinal sectional view of the composite rod shown on FIG. 1. The reinforced region 2 and each of the metallic regions 4 extend along the longitudinal axis of the rod. While it is preferred that each region extend continuously from a first end of the article to a second end of the article, each region may extend substantially continuously from the first end of the article to the second end of the article. A region which extends substantially continuously from the first end of the article to the second end of the article may be interrupted by discontinuities as long as the discontinuities do not adversely affect the tensile strength, elastic modulus, and impact resistance of the article.

Figure 3:
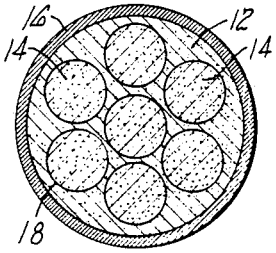
FIG. 3 shows a schematic cross-sectional view of a second composite rod of the present invention.
Figure 4:
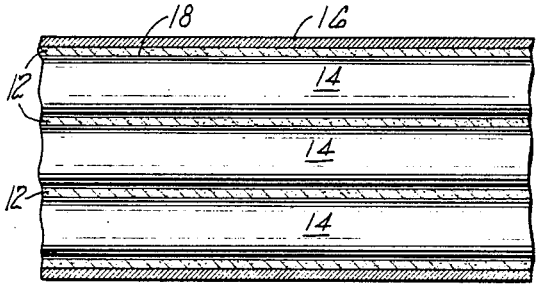
FIG. 4 shows a schematic longitudinal view of the composite rod of FIG. 3.

The microstructure of a second composite rod of the present invention is shown in FIGS. 3 and 4.

FIG. 3 shows a cross-sectional view of a composite rod of the present invention. A first reinforced region 12 forms a two-dimensional network in the cross-sectional plane to separate each of a plurality of second reinforced regions 14 from each of the other reinforced regions 14. Each of the discrete second reinforced regions 14 is enclosed in all direction in the cross-sectional plane by the first reinforced region 12. The rod is enclosed in a metallic sheath 16. The first metallic region and the second metallic regions each comprise metal alloy matrix reinforced with ceramic particles. The composition of the second reinforced regions may be different from the composition of the first reinforced region.

In the preferred embodiment shown in FIG. 3, the second reinforced regions 14 each have a circular cross section. The second reinforced regions may have cross-sectional shapes other than a circular shape, and each of the second reinforced regions may have a cross-sectional shape that is different from the other second reinforced regions. For example, the second reinforced regions may have ovoid, square, rectangular or other noncircular cross-sectional shapes. The first reinforced region may have any shape complementary to the shape of the second reinforced regions.

Each of the regions is contiguous with other regions and the contiguous regions are interconnected to form a coherent article. Each of the second reinforced regions 14 is bonded to the first reinforced region to form a stable interfacial boundary 18 between each second reinforced region 14 and the first reinforced region 12. The interfacial shear strength of each interfacial boundary is sufficiently high so that load may be transferred between the adjoining regions. It is preferred that each interfacial boundary be sharply defined. A stable, sharply defined interface between adjoining regions may be obtained if the composition of the adjoining regions is chosen so that only limited interdiffusion occurs between the adjoining regions at temperatures up to and including the intended use temperature.

While a composite article of the present invention may include as few as two discrete second reinforced regions, improved performance may be obtained if the number of second reinforced regions is increased. It is preferred that the article include five or more second reinforced regions, and particularly preferred that the article comprise ten or more second reinforced regions.

While is it sufficient for the purposes of the present invention that two second reinforced regions are each substantially enclosed by the first reinforced region, improved performance may be obtained by increasing the number of enclosed second reinforced regions, and it is preferred that five or more second reinforced regions be enclosed by the first reinforced region.

FIG. 4 shows a longitudinal sectional view of the composite rod shown in FIG. 3. The first reinforced region 12, the second reinforced regions 14 and the interfacial boundary 18 between the first reinforced region 12 and each second reinforced region 14 each extend along the longitudinal axis of the rod. While it is preferred that each region extend continuously from the first end of the article to the second end of the article, each region may extend substantially continuously from the first end of the article to the second end of the article.

While in the preferred embodiment shown in FIGS. 3 and 4, a single continuous metallic region 16 defines the outer perimeter of the cylindrical rod, it should be noted that a composite bar machined from the composite rod shown in FIGS. 3 and 4 and having a square or rectangular cross-sectional shape and having at least two second reinforced regions which are completely enclosed in the first reinforced region is another embodiment of the present invention.

Figure 5:
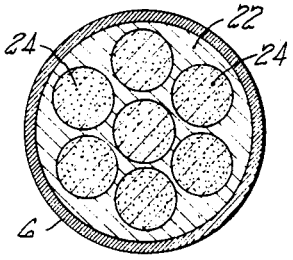
FIG. 5 shows a schematic cross-sectional view of a third composite rod of the present invention.
Figure 6:
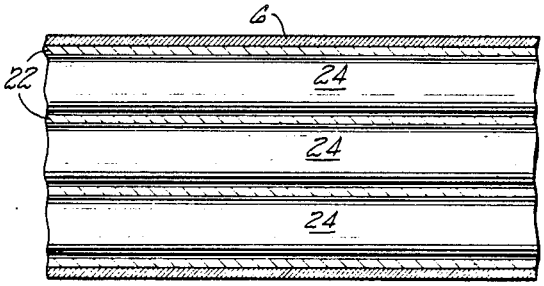
FIG. 6 shows a schematic longitudinal view of the composite rod of FIG. 5.

The microstructure of a third composite rod of the present invention is shown in FIGS. 5 and 6.

FIG. 5 shown a cross-sectional view of a composite rod of the present invention. A metallic region 22 forms a two-dimensional network in the cross-sectional plane to separate each of a plurality of reinforced regions 24 from each of the other reinforced regions 24. Each of the discrete reinforced regions 24 is enclosed in all directions in the cross-sectional plane by the metallic region 22. The rod is enclosed in a metallic sheath 6. The metallic region 22 comprises unreinforced metal alloy. The reinforced regions 24 each comprise a metal alloy matrix reinforced with ceramic particles. The metal alloy of the reinforced regions may be a different metal alloy than the metal alloy of the metallic region. Each of the reinforced regions may comprise a metal alloy that is different from the metal alloy of the other reinforced regions. The composition of the respective regions is discussed in more detail below.

Each of the metallic regions and reinforced regions is contiguous with other regions and the contiguous regions are interconnected to form a coherent article. Each of the regions adjoins other regions of the article and is bonded to the regions which it adjoins to form a common interface between the adjoining regions. The interfacial shear strength of each common interface is sufficiently high so that load may be transferred between the adjoining regions. It is preferred that each common interface be stable within the temperature range of intended use, and it is particularly preferred that each common interface be sharply defined.

While a composite article of the present invention may include as few as two discrete reinforced regions, improved performance may be obtained if the number of reinforced regions is increased. It is preferred that the article include five or more reinforced regions, and particularly preferred that the article comprise ten or more reinforced regions.

While is it sufficient for the purposes of the present invention that two reinforced regions are each substantially enclosed by the metallic region, improved performance may be obtained by increasing the number of enclosed reinforced regions, and it is preferred that five or more reinforced regions b enclosed by the metallic region. In the preferred embodiment shown in FIG. 5 the reinforced regions 24 each have circular cross-sectional shapes. The reinforced regions 24 may have cross-sectional shapes other than a circular cross-sectional shape, and each of the reinforced regions 24 may have a cross-sectional shape that is different from the other reinforced regions. For example, the reinforced regions may have ovoid, square, rectangular or other noncircular cross-sectional shape.

While in the preferred embodiment shown in FIGS. 5 and 6, a single continuous metallic region 6 defines the outer perimeter of the cylindrical rod, it should be noted that a composite bar machined from the composite rod shown in FIGS. 5 and 6 and having a square or rectangular cross-sectional shape with its rectilinear perimeter defined by alternating metallic and reinforced surfaces and having at least two reinforced regions which are completely enclosed in the metallic region is another embodiment of the present invention.

FIG. 6 shows a longitudinal sectional view of the composite rod shown in FIG. 5. The metallic region 22 and the reinforced regions 24 each extend along the longitudinal axis of the rod. While it is preferred that each region extend continuously from a first end of the article to the second end of the article, each region may extend substantially continuously from the first end of the article to the second end of the article.

The process of the present invention is a preferred method for fabricating the article of the present invention. Briefly, a plurality of structural elements are each positioned within a metallic container so that the container and structural elements define one or more longitudinally extending void spaces within the container. A quantity of particles, comprising metallic particles or a particulate mixture of metallic particles and ceramic particles is introduced into the void spaces. The container, structural elements and particles are then consolidated by exposure to elevated pressure at an elevated temperature to form a composite article of the present invention.

The metallic container may be any metallic container having a continuous inner surface which extends along a longitudinal axis from a closed end of the container to an open end of the container to define an internal void space. The void space is characterized by a depth which corresponds to the distance between the closed end of the container and the open end of the container and a cross-sectional dimension, for example, a diameter, which corresponds to a characteristic cross-sectional distance. It is preferred that the depth of the void space be very large relative to the cross-sectional dimension of the void space. For example, a right circular cylindrical can is suitable as the container as are similar containers having square, rectangular or other cross-sectional shapes.

The structural elements each extend longitudinally from a first end of the structural element to a second end of the structural element and may have any cross-sectional shape. Each of the structural elements may be characterized by a length, corresponding to the distance between the first end of the structural element and the second end of the structural element and by a characteristic cross-sectional dimension, for example, a diameter. It is preferred that the length of the structural elements be very large relative to the characteristic cross-sectional dimension of the structural elements. The structural elements may comprise a metal alloy rod or a ceramic particle reinforced metal matrix composite rod. The rods may have circular cross-sectional shapes or may have square, rectangular or other noncircular shape.

The structural elements are positioned within the metallic container so that the structural elements are packed to remain substantially parallel to each other and the metallic container and the structural elements define one or more longitudinally extending void spaces within the metallic container. For a given article, the cross-sectional dimensions of the can and of the structural elements are chosen so that a plurality of structural elements may be positioned parallel to each other within the metallic container with the longitudinal axis of each structural element oriented along the longitudinal axis of the metallic container. While it is preferred that all structural elements, within a particular container be the same composition and shape, a combination of structural elements may be used. It is not necessary that each of the structural elements be of the same cross-sectional dimensions. It is preferred that the structural elements are of substantially equal length and that the length of each structural element is slightly less than the depth of the void defined by the metallic container. For example, an array of parallel tubes or an array of parallel rods may be positioned within the metallic container.

A quantity of particles comprising metallic particles or a particulate mixture of metallic particles and ceramic particles is introduced into the void spaces defined by the container and the structural elements. It is preferred that a sufficient quantity of particles be introduced to substantially fill all of the discrete void spaces within the metallic container. Preferably, the metallic container and structural element assembly is vibrated during the introduction of the particles to permit closed packing of the particles. The structural elements are packed such that particles may flow between the structural elements. Preferably, once the discrete void spaces of the metallic container and structural element assembly are filled the filled assembly is vacuum degassed at an elevated temperature. The assembly is then sealed by crimping the open end of the metallic container.

The metallic container containing the structural elements and the particles is consolidated by exposure to elevated pressure at an elevated temperature to form a coherent article. Conventional consolidation processes such as hot pressing, hot isostatic pressing followed by extrusion or direct extrusion consolidation may be used. The particular consolidation processing parameters depend on the composition of the particular article and are familiar to those skilled in the art.

The consolidated article is suitable as a feedstock for subsequent working operations such a forging or machining.

The particulate mixture, and ceramic particle reinforced metal matrix composite rods of the process of the present invention, and reinforced regions of the article of the present invention each comprise a metal alloy matrix reinforced with ceramic particles.

Suitable metal alloy matrix materials are those metal alloys which can be formed at elevated temperatures using conventional metal working techniques. Suitable metal alloys include alloys of magnesium, titanium, nickel, niobium, aluminum and "intermetallics" such as nickel aluminide, niobium aluminide or titanium aluminide.

Ceramic particles which are compatible with the metal alloy matrix are suitable for use with the present invention. Compatibility with the matrix metal alloy matrix means that there is no or, at most, very limited interdiffusion between the ceramic particles and the matrix that there is no or, at most, very limited dissolution of the ceramic particles in the matrix and that a strong bond may be formed between the ceramic particles and the matrix. The ceramic particles may be either ceramic whiskers or ceramic platelets. Suitable ceramic materials include silicon carbide, alumina, titanium diboride and boron carbide.

The metallic container, and the metallic rods process of the present invention, and the metallic regions of the article of the present invention each comprise a metal alloy.

Metal alloys which are tough, ductile, workable within the same temperature range as the metal alloy matrix material, and compatible with the matrix material are suitable metal alloys for practice of the present invention. Compatibility with the matrix means that there is no or, at most, very limited interdiffusion between the metal alloy of the metallic region and the matrix at the use temperature of the article and no or, at most, very limited dissolution of either the metal alloy of the metallic region in the metal alloy matrix or of the metal alloy matrix material in the metal alloy of the metallic region. Suitable metal alloy include alloys of aluminum and titanium as well as stainless steel alloys. Each metallic region may be bounded by a layer of a metal oxide so that a stable sharply defined, interfacial boundary may be obtained between adjoining regions.

The composition and relative volumes of the metallic container, the structural elements, and the metallic particles or the particulate mixture of metallic particles and ceramic particles of the process of the present invention are chosen and to provide a composite article of a particular composition.

The composite article of the present invention comprises between about 10 volume percent and about 30 volume percent ceramic particles and from about 70 volume percent to about 90 volume percent metal alloy. It is preferred that the article comprise between about 15 volume percent and about 25 volume percent ceramic reinforcement and from about 75 volume percent to about 85 volume percent metal alloy.

The reinforced regions each comprise from about 40 volume percent to about 80 volume percent metal alloy matrix and from about 20 volume percent to about 60 volume percent ceramic particles. It is preferred that the metal alloy matrix comprise from about 60 volume percent to about 80 volume percent of the reinforced regions and the ceramic particles comprise between about 20 volume percent and about 40 volume percent of the reinforced regions.

Typically, the article of the present invention comprises from about 10 volume percent to about 70 volume percent metallic regions and from about 30 volume percent to about 90 volume percent reinforced regions.

EXAMPLE 1

An array of 7 6061 aluminum rods is positioned within a cylindrical 6061 aluminum can. A particulate mixture consisting of 50 weight percent aluminum 6061 aluminum powder and 50 weight percent silicon carbide particle is introduced to fill the longitudinally extending void spaces defined by the can and rods. The can rod and particulate mixture assembly is vacuum degassed for 30 minutes and 950° F., and then extruded at 850° F. through a cylindrical die. A cross-sectional view of the rod is shown in FIG. 1, and a longitudinal view of the rod is shown in FIG. 2.

EXAMPLE 2

An array of 7 particulate ceramic reinforced 6061 aluminum matrix composite rods are positioned within a cylindrical 6061 aluminum can. The rods each comprise 50 weight percent 6061 aluminum and 50 weight percent silicon carbide reinforcement. A particulate mixture consisting of 50 weight percent 6061 aluminum powder and 50 weight percent silicon carbide particles is introduced to fill the longitudinally extending void spaces defined by the can and rods. The can rod and particulate mixture assembly is vacuum degassed for 30 minutes at 950° F. and then extruded at 85020 F. through a cylindrical die. A cross-sectional view of the rod is shown in FIG. 3 and a longitudinal view of the rod is shown in FIG. 4.

EXAMPLE 3

An array of 7 particulate ceramic reinforced 6061 aluminum matrix cylindrical rods is positioned within a cylindrical 6061 aluminum can. A quantity of 6061 aluminum powder is introduced to fill the longitudinally extending void space defined by the can and rods. The can rod and particle assembly was vacuum degassed and extruded at 850° F. through a cylindrical die. A cross-sectional view of the rod is shown in FIG. 5 and a longitudinal view of the rod is shown in FIG. 6.

While not wishing to be bound by any particular theory, there appears to be a microstructural basis for the improved impact resistance exhibiting by the composite article of the present invention. The basis appears to be the presence of alternately regions of stiff, brittle ceramic reinforced metal and regions of ductile unreinforced metal and/or the presence of internal interfaces between the regions. A crack propagating in any direction perpendicular to the longitudinal axis with a reinforced region will eventually encounter a reinforced region/metallic region interface. The tip of the crack is blunted upon encountering the interface and then encounters a more ductile region, greatly reducing the driving force for crack propagation.

Although this invention has been shown and described with respect to detailed embodiments thereof, it will be understood by those skilled in the art that various changes in form and detail thereof may be made without departing from the spirit and scope of the claimed invention.

We claim:

1. A process for making composite article comprising:

providing a metallic container, said metallic container having a substantially continuous inner surface which extends along a first axis from an open container, positioning a plurality of longitudinally extending metallic rods along the first axis within the metallic container so that the structural elements and the container define one or more void spaces which extend along the first axis of the container, introducing a quantity of a particulate mixture, into each of the void spaces to substantially fill each of the void spaces, said particulate mixture comprising a mixture of metallic particles and ceramic particles, and consolidating the metallic container, the metallic rods and the particulate mixture at elevated temperature and pressure to form the composite article 2. A composite article made by the process of claim 1.

3. A process for making a composite article, comprising:

providing a metallic container, said metallic container having a substantially continuous inner surface which extends along a first axis from an open end of the container to a closed end of the container, positioning a plurality of longitudinally extending particulate ceramic reinforced metal matrix composite rods along the first axis within the metallic container so that the rods and the container define one or more void spaces which extend along the first axis of the container, introducing a quantity of a particulate mixture into each of the void spaces to substantially fill each of the void spaces, said particulate mixture comprising a mixture of metallic particles and ceramic particles, and consolidating the metallic container, the rods and the particulate mixture at elevated temperature and pressure to form the composite article.

4. A composite article made by the process of claim 3.

5. A process for making a composite article, comprising:

providing a metallic container, said metallic container having a substantially continuous inner surface which extends along a first axis of an open end of the container to a closed end of the container, positioning a plurality of longitudinally extending particulate ceramic reinforced rods along the first axis within the metallic container so that the structural elements and the container define one or more void spaces which extend along the first axis, introducing a quantity of metallic particles into each of the discrete void spaces to substantially fill each of the discrete void spaces, and consolidating the metallic container, the rods and the metallic particles at elevated temperature and pressure to form the composite article.

6. A composite article made by a process of claim 5.

* * * * *

UNITED STATES PATENT AND TRADEMARK OFFICE

CERTIFICATE OF CORRECTION

PATENT NO. : 4,885,212

DATED : December 5, 1989

INVENTOR(S) : Karl M. Prewo; Vincent C. Nardone; and James R. Strife

It is certified that error appears in the above-identified patent and that said Letters Patent is hereby corrected as shown below:

Claim 1, column 10, line 1, after "open" insert --end of the container to a closed end of the--.

Signed and Sealed this

Eleventh Day of December, 1990

*Attest:*

HARRY F. MANBECK, JR.

*Attesting Officer*

*Commissioner of Patents and Trademarks*